US007193569B2

(12) United States Patent
Vesterinen

(10) Patent No.: US 7,193,569 B2
(45) Date of Patent: Mar. 20, 2007

(54) DOUBLE-LAYER ANTENNA STRUCTURE FOR HAND-HELD DEVICES

(75) Inventor: Jukka Vesterinen, Jyväskylä (FI)

(73) Assignee: Nokia Corporation, Espoo (FI)

( * ) Notice: Subject to any disclaimer, the term of this patent is extended or adjusted under 35 U.S.C. 154(b) by 58 days.

(21) Appl. No.: 10/755,715

(22) Filed: Jan. 12, 2004

(65) Prior Publication Data

US 2005/0151689 A1 Jul. 14, 2005

(51) Int. Cl.
*H01Q 1/24* (2006.01)

(52) U.S. Cl. ..... 343/702

(58) Field of Classification Search ..... 343/700 MS, 343/702, 703, 711, 829, 830
See application file for complete search history.

(56) References Cited

U.S. PATENT DOCUMENTS 6,249,254 B1 6/2001 Bateman et al. ..... 343/700 MS
6,362,789 B1 * 3/2002 Trumbull et al. .... 343/700 MS
6,388,636 B1 * 5/2002 Brown et al. ..... 343/866
6,396,458 B1 * 5/2002 Cockson et al. ..... 343/860
6,670,923 B1 * 12/2003 Kadambi et al. .... 343/700 MS
2003/0214437 A1 * 11/2003 Rawnick et al. ..... 343/700 MS

* cited by examiner

*Primary Examiner*—Trinh Dinh
*Assistant Examiner*—Huedung Mancuso

(57) ABSTRACT

The invention relates to a device, comprising an at least partially plane antenna carrier with a first side and a second side, at least one first Printed Wiring Board (PWB) being attached to said first side of said antenna carrier and having a first radiation structure formed on it, and at least one second PWB being attached to said second side of said antenna carrier. Said second PWD structure preferably represents a parasitic antenna element that improves the radiation pattern of an antenna that at least partially is represented by said first radiation structure. The invention further relates to a GPS-capable mobile phone, a method, a computer program and a radio system.

24 Claims, 4 Drawing Sheets

DOUBLE-LAYER ANTENNA STRUCTURE FOR HAND-HELD DEVICES

FIELD OF THE INVENTION

The invention relates to a device that comprises an at least partially plane antenna carrier with a first side and a second side and at least one first Printed Wiring Board (PWB) that is attached to the first side of the antenna carrier and that has a first radiation structure formed on it.

BACKGROUND OF THE INVENTION

Antennas in hand-held devices such as mobile phones or receivers for satellite navigation systems represent the interface between the hand-held device and the wireless transmission channel, over which electromagnetic signals of a given bandwidth and center frequency are received and/or transmitted. The gain of an antenna for a given frequency range thus is generally considered as an important factor in link budget considerations that determine the maximum transmission power and its dynamic range for both the hand-held device and the device the hand-held device is transmitting to or receiving from. With hand-held devices being battery-powered, it is highly desirable to reduce the required transmission powers to increase the operating time of the hand-held device. Inter alia, this can be achieved by increasing the antenna gain.

The gain of an antenna is generally both frequency- and angle-dependent, and consequently, it is the primary aim of antenna design to achieve satisfactory gain behaviour for a given frequency range and angular domain. Secondary aims that become more and more important with the increasing miniaturisation of hand-held devices and the growing competition are small antenna sizes, less weight and reduced costs. With the advent of hand-held devices that are capable of operating different mobile radio system standards (e.g. the Global System for Mobile Communications (GSM) or the Universal Mobile Telecommunications System (UMTS)) and further radio system standards such as satellite navigation system standards (e.g. the Global Positioning System (GPS) or the Galileo system) or short-range wireless communication standards (e.g. the Bluetooth short-range device interconnection system), antenna design further faces the requirement to cover several frequency ranges with one antenna structure or to efficiently combine antennas for each required frequency range into one device. The portability of antenna designs from one hand-held device to a second hand-held device, which is highly desirable to reduce R&D costs, in particular is aggravated by the effect that the antenna characteristics are heavily influenced by other metallic parts of the hand-held device, for instance the central circuit board of the hand-held device. However, for some antenna types, these other metallic parts of the hand-held device are intentionally used as a surrogate for a ground plane, so that lack of portability is inherent to the antenna design.

FIG. 1 depicts an example of a state-of-the-art antenna structure of a mobile-phone in exploded view. The antenna structure consists of an antenna carrier 1, a flex-print structure 2, pogo pins 3-3 . . . 3-7 and a decorative label 4, which are all assembled as indicated by the exploded view.

The antenna carrier 1 consists of a crystalline polymer (Questra) and, except for the reinforced parts, has a thickness of 800 μm. It should be noted that this value, similar as all other exact values provided in this description, is to be taken as an exemplary value which does not restrict the scope of the invention.

The flex-print 2 is a one-layer Printed Wiring Board (PWB) consisting of a 100 μm layer of Polyethylene Terephthalate (PET), a 20 μm copper layer that covers the PET layer and an 100 μm adhesive layer below the PET layer. In FIG. 1, the flex-print 2 is seen from the backside, so that the adhesive layer is facing the antenna carrier 1.

By punching out or etching, two radiation structures 2-1 and 2-2 have been formed on said flex-print 2, i.e. copper from said flex-print 2 has been removed so that only the copper that forms the radiation structures 2-1 and 2-2 is left on the PET layer. Said radiation structures 2-1 and 2-2 formed of copper on said PET layer face the decorative label 4 and are thus depicted in dashed lines. Radiation structure 2-1 represents a Planar-Inverted-F-Antenna (PIFA) suited for use in the frequency range of mobile radio systems such as for instance the GSM or UMTS. Note that, for the PIFA, both the radiation structure 2-1 and the ground plane are formed in copper on the PET layer of flex-print 2, thus the dashed lines depicted in FIG. 1 illustrate both the radiation structure 2-1 and the ground plane of said PIFA. Radiation structure 2-2 represents a line-shaped, partially bent antenna that is suited for use in the frequency range of the Global Positioning System (GPS).

The flex-print 2 further comprises noses 2-3 . . . 2-7 that are fabricated by partially cutting the copper-clad portions on said flex-print 2 and bending the respective part of the flex-print between the cuts so that respective noses 2-3 . . . 2-7 arise that are rectangular to the flex-print 2. The noses 2-3 . . . 2-7 allow to electrically contact the radiation structures 2-1 and 2-2, and, in the case of the PIFA, also the ground plane of the PIFA that is also formed in copper on the PET layer of flex-print 2. When said flex-print 2 is attached to said antenna carrier 1, the noses 2-3 . . . 2-7 penetrate the respective openings 1-3 . . . 1-7 formed in the antenna carrier. If then metallic pogo pins 3-3 . . . 3-7 are snapped into these respective openings 1-3 . . . 1-7, the noses 2-3 . . . 2-7 are crimp-connected to said respective pogo pins 3-3 . . . 3-7. The radiation structure 2-2 (pogo pin 3-6 and/or 3-7) and 2-1 (pogo pin 3-3) and the ground plane (pogo pins 3-4 and 3-5) of the PIFA antenna can then be contacted via the top of the respective pogo pin 3-3 . . . 3-7 that protrudes through the respective opening 1-3 . . . 1-7.

The final application of the decorative label 4, in the example of FIG. 1 a 200 μm thick layer, protects the flex-print 2 and in particular the radiation structures 2-1 and 2-2 from physical damage and corrosion.

Due to the fact that two antennas are integrated into the antenna structure of FIG. 1, namely one GPS antenna and one antenna for a mobile radio system, the exploitable degrees of freedom in antenna design are limited, in particular with respect to the available area that can be used for the layout of the antennas.

SUMMARY OF THE INVENTION

It is proposed a device, comprising an at least partially plane antenna carrier with a first side and a second side, at least one first Printed Wiring Board (PWB) being attached to said first side of said antenna carrier and having a first radiation structure formed on it, and at least one second PWB being attached to said second side of said antenna carrier.

Said device may for instance be a hand-held device such as a mobile phone or a receiver for a satellite navigation system, or a combination thereof. It may equally well be an internal or external antenna of such a hand-held device or of another device being capable of operation according to a mobile radio system standard and/or a satellite navigation system standard, for instance a device built into a car or plane.

Said device comprises an antenna carrier, which may be of dielectric material, and which may be essentially plane, so that at least two sides can be differentiated. Said first side may for instance be the top side of said antenna carrier, and said second side may be the bottom side, or vice versa. On said first side, at least one first PWB is attached. Said PWB may for instance be a one layer structure that is composed of a dielectric layer and a metallic layer, in particular a copper layer. Said PWB may be flexible, like a flexi-print, or may be non-flexible, like a plate. Below the dielectric layer, an adhesive layer may be provided to allow for the attachment of the PWB. By etching, cutting or similar techniques, a first radiation structure is formed on said PWB. This may require the removal of at least some of the metallic layer from said PWB. However, said radiation structure may equally well be formed on said PWB by cutting the entire PWB into a certain shape, so that the dielectric layer of the cut PWB is still entirely covered by the metallic layer. Said first radiation structure may be connected to a feeding pin of an antenna connector or antenna interface of a central circuit board of said device. A ground plane associated with said first radiation structure may be formed by said first PWB as well. Said ground plane may alternatively be formed by other metallic parts of said device or of metallic parts in the vicinity of said device. Said first radiation structure may take different shapes according to the antenna type it represents, for instance lines, or circles, or parts thereof.

On the second side of said antenna carrier, at least one second PWB is attached. Said second PWB may be positioned with respect to said first PWB so that said first and second PWB partially overlap. Alternatively, there may be no overlap. Said second PWB may have the same composition as the first PWB, i.e. the same dielectric layer and metallic layer, or may vary in thickness of the layers and selection of the materials. It may be flexible like a flexi-print, or non-flexible like a plate. Also the form of the second PWB may take different shapes. The second PWB does not necessarily have to be etched or cut to remove portions of the metallic layer. It may be preferred that said second PWB is attached to said antenna carrier so that its dielectric layer faces the antenna carrier. It may also be advantageous to provide more than one second PWB on the second side of said antenna carrier.

The position and shape of the at least one second PWB that is attached on the second side of said antenna carrier to obtain a double-layer antenna structure offers an additional degree of freedom in tuning an antenna that is at least partially formed by said first radiation structure on said first PWB. Tuning may comprise the adjustment of the antenna gain for specific frequency and/or angular ranges. Said second PWB may act as a parasitic element that is not connected to a ground plane or ground contact associated with that first radiation structure, or may be connected to such a ground plane. Furthermore, said second PWB may also be electrically connected to said first radiation structure to extend the radiation structure.

According to the device of the present invention, it may be preferred that said first and/or second PWBs are one layer PWBs that comprise at least one metallic layer and/or at least one dielectric layer. Said PWBs may for instance be a flexi-print that comprises a layer of Polyethylene Terephthalate (PET) as dielectric layer and a layer of copper as metallic layer.

According to the device of the present invention, it may be preferred that said first and/or second PWBs further comprise at least one adhesive layer, and that said first and/or second PWBs are attached to said antenna carrier via said adhesive layer.

According to the device of the present invention, it may be preferred that a ground plane for said first radiation structure is at least partially formed by metallic elements of said device.

According to the device of the present invention, it may be preferred that said second PWB is electrically connected to said ground plane. Said second PWB then acts as an extension of said ground plane.

According to the device of the present invention, it may alternatively be preferred that said second PWB is a parasitic antenna element. Said parasitic antenna element is neither electrically connected to said ground plane nor to said first radiation structure. Said second PWB may then be isolated from both the first radiation structure and the remaining metallic parts contained in said device. However, due to coupling between the first radiation structure and the second PWB and/or due to coupling between a ground plane associated with said first radiation structure and said second PWB, the radiation pattern of the antenna that is at least partially represented by said first radiation structure may be advantageously influenced.

According to the device of the present invention, it may be preferred that said device further comprises a protection layer that at least partially covers said first PWB. Said protection layer secures the first PWB and in particular the first radiation structure from physical damage and environmental influence such as corrosion.

According to the device of the present invention, it may be preferred that said device further comprises at least one pogo pin that penetrates said antenna carrier to electrically contact said radiation structure of said first PWB. Said pogo pin may be an at least partially cylindric metallic element that may comprise a spring in order to allow for an elastic length reduction. Said pogo pin may lock into place when being inserted into an opening of said antenna carrier. Furthermore, when being inserted into said opening of said antenna carrier, said pogo pin may crimp-connect a nose of said first PWB that has been inserted into said opening before and carries a metallic line that electrically connects said first radiation structure on said first PWB. Said pogo pin then may be used to electrically connect said first radiation structure to a central circuit board of said device.

According to the device of the present invention, it may be preferred that said first PWB is positioned on said first side of said antenna carrier and that said second PWB is positioned on said second side of said antenna carrier so that said first and second PWB at least partially overlap.

According to the device of the present invention, it may be preferred that said first radiation structure is essentially line-shaped. Said first radiation structure then has a length that is significantly larger than its width. The width of said line does not necessarily have to be constant over the length of said line.

According to the device of the present invention, it may be preferred that said first radiation structure is at least partially bent. Said first radiation structure may for instance resemble a part of a ring.

According to the device of the present invention, it may be preferred that said second PWB is essentially plane. Said second PWB thus may resemble a square or a circle or parts thereof.

According to the device of the present invention, it may be preferred that said antenna carrier consists of a dielectric material. Said antenna carrier may for instance consist of a low-loss dielectric material such as a crystalline polymer that is partially filled with glass, for instance Questra.

According to the device of the present invention, it may be preferred that a second radiation structure is formed on said first PWB, that said first radiation structure is tuned to a first frequency range and that said second radiation structure is tuned to at least one second frequency range. In addition to said first radiation structure, which represents the radiating part of a first antenna that is designed for operation in a first frequency range that is characterised by a first centre frequency and first bandwidth, a second radiation structure representing the radiating part of a second antenna that is designed for operation in at least one second frequency range that is characterised by a second center frequency and second bandwidth, is provided on said first PWB. Said second radiation structure may equally well be tuned to more than one frequency range. Depending on the position of said second PWB, said second PWB may allow for the tuning of either the first or the second antenna, or for the tuning of both. Said first and second radiation structures may be positioned side by side or in an overlapping fashion on said first PWB. It is understood that said first and second radiation structures may be formed on two first PWBs being attached to said first side of said antenna carrier, respectively, so that each radiation structure is formed on one respective first PWB. This may allow for different first PWBs to be used as a basis for the respective first and second radiation structure.

According to the device of the present invention, it may be preferred that said device is a hand-held device, in particular a GPS-capable or Galileo-capable mobile phone. Said device may for instance be a mobile phone according to the GSM, UMTS or IS-95 standard or combinations thereof, and may be further equipped with a receiver for signals that are transmitted by satellites of the GPS or Galileo system.

According to the device of the present invention, it may be preferred that said first frequency range is a frequency range of a satellite navigation system and wherein said at least one second frequency range is a frequency range of a mobile radio system.

It is further proposed a device operated according to a mobile radio system standard and a satellite navigation system standard, comprising an at least partially plane antenna carrier with a first side and a second side, at least one first PWB being attached to said first side of said antenna carrier and having a first and a second radiation structure formed on it, and at least one second PWB being attached to said second side of said antenna carrier as a parasitic antenna element, wherein said first radiation structure is tuned to a first frequency range and wherein said second radiation structure is tuned to at least one second frequency range.

It is further proposed a method for generating a radiation pattern of an antenna, wherein said antenna comprises an at least partially plane antenna carrier with a first side and a second side, and at least one first Printed Wiring Board (PWB) that is attached to said first side of said antenna carrier and has a first radiation structure formed on it, said method comprising attaching at least one second PWB to said second side of said antenna carrier.

It is further proposed a computer program with instructions operable to cause a processor to control a radiation of an antenna, wherein said antenna comprises an at least partially plane antenna carrier with a first side and a second side, at least one first Printed Wiring Board (PWB) being attached to said first side of said antenna carrier and having a first radiation structure formed on it, and at least one second PWB being attached to said second side of said antenna carrier. Said computer program may for instance be loaded into the internal memory of a central processing unit of a device that comprises said antenna. Controlling said antenna may comprise amplification of signals that are transmitted and received by said antenna.

It is further proposed a radio system, comprising at least one base station, and at least one mobile station, wherein said at least one mobile station comprises an at least partially plane antenna carrier with a first side and a second side, at least one first Printed Wiring Board (PWB) being attached to said first side of said antenna carrier and having a first radiation structure formed on it, and at least one second PWB being attached to said second side of said antenna carrier. Said radio system may for instance be a mobile radio system as for instance the GSM or the UMTS, or a satellite navigation system as for instance the GPS or the Galileo system. In the first case, the base stations are base stations of the mobile radio system, whereas in the second case, the base stations are represented by transmitting satellites.

According to the radio system of the present invention, it may be preferred that said mobile station is capable of receiving signals transmitted by at least one satellite and of at least partially determining its position from said received signals.

These and other aspects of the invention will be apparent from and elucidated with reference to the embodiments described hereinafter.

DETAILED DESCRIPTION OF THE INVENTION

Figure 2:
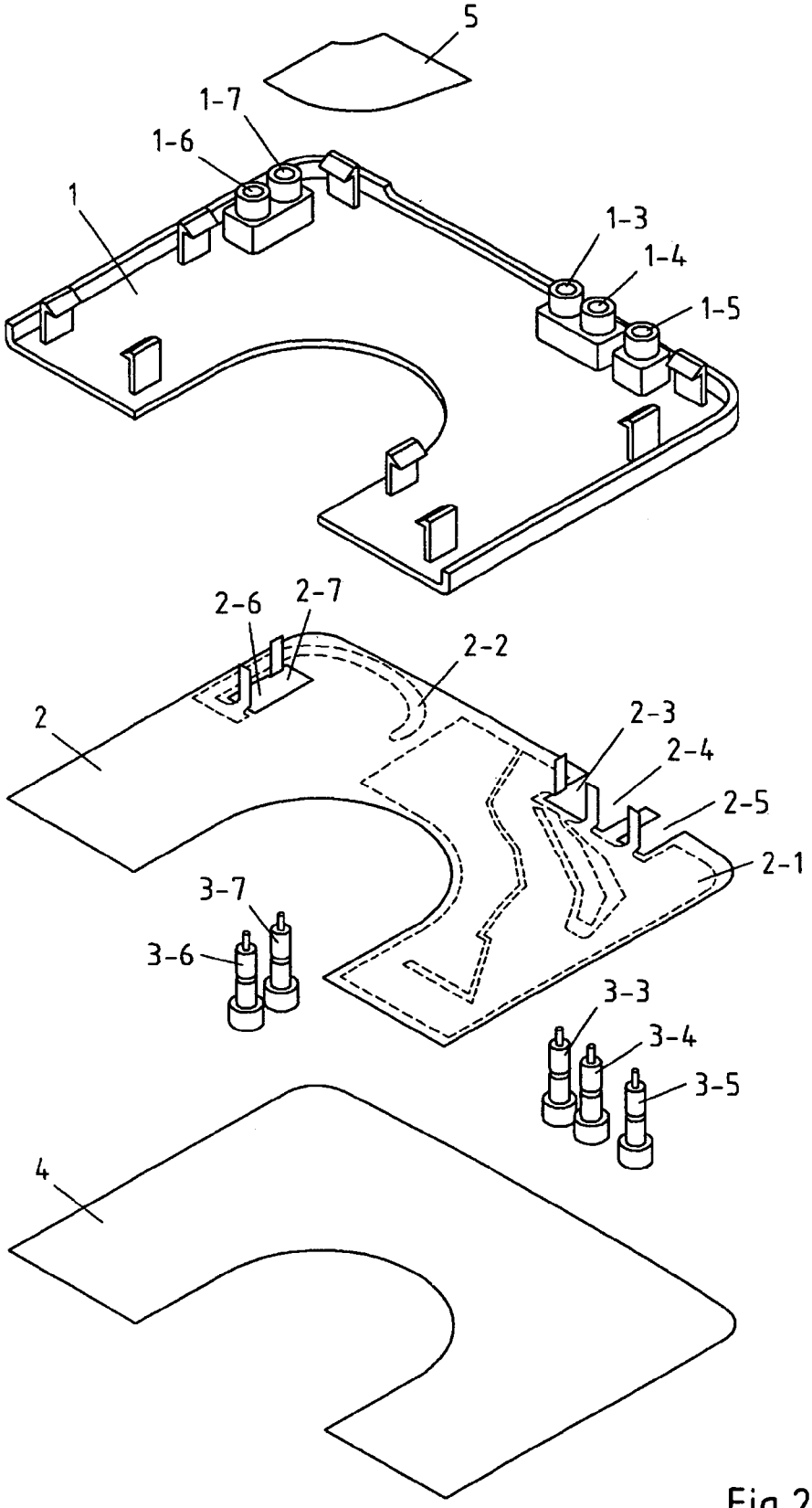
FIG. 2: an exploded view of an antenna structure according to the present invention.
Figure 3:
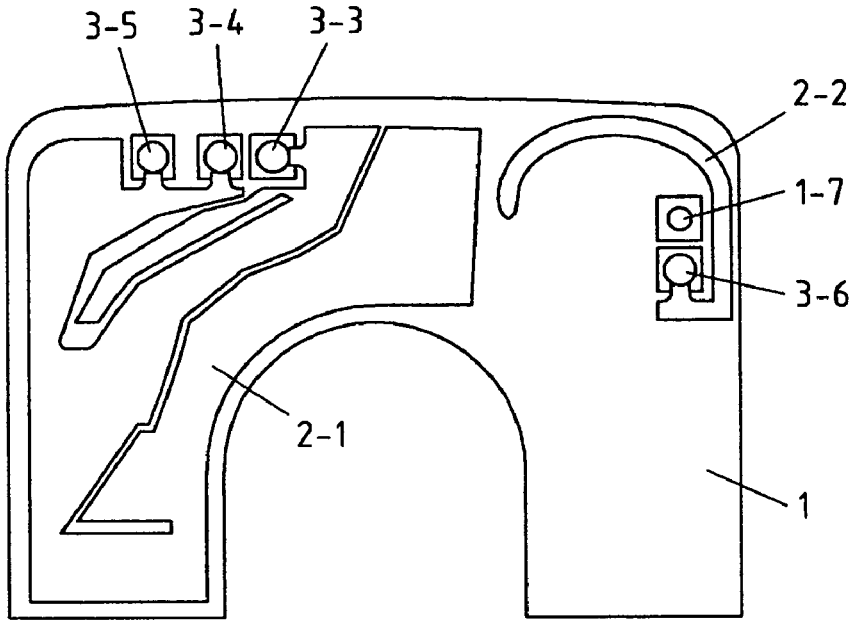
FIG. 3: a front view of an antenna structure according to the present invention.
Figure 4:
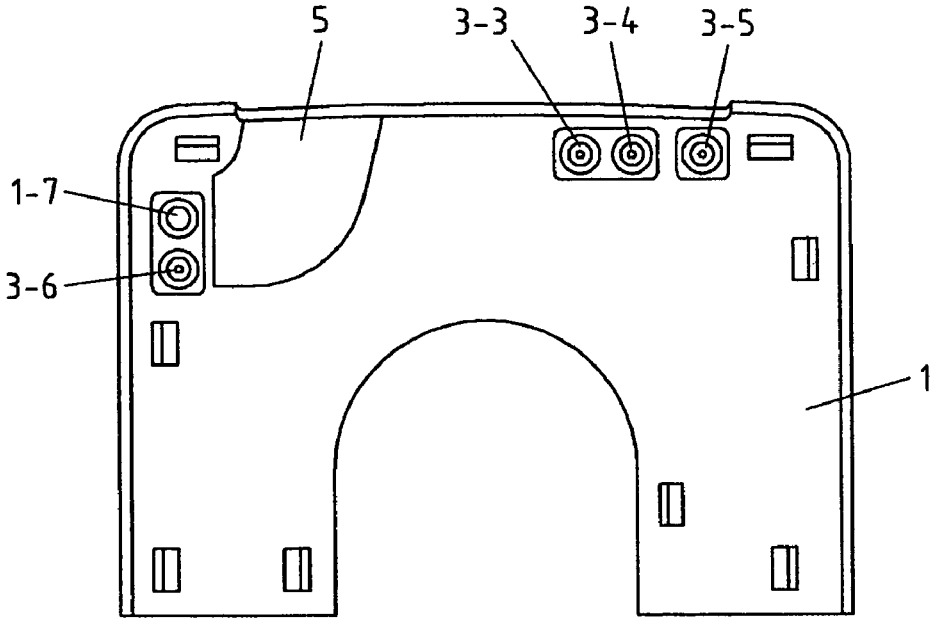
FIG. 4: a back view of an antenna structure according to the present invention.

FIGS. 2, 3 and 4 depict an exploded view, a front view and a back view of an antenna structure according to the present invention, respectively. In all figures of this invention, like elements are denoted with the same reference signs.

Figure 1:
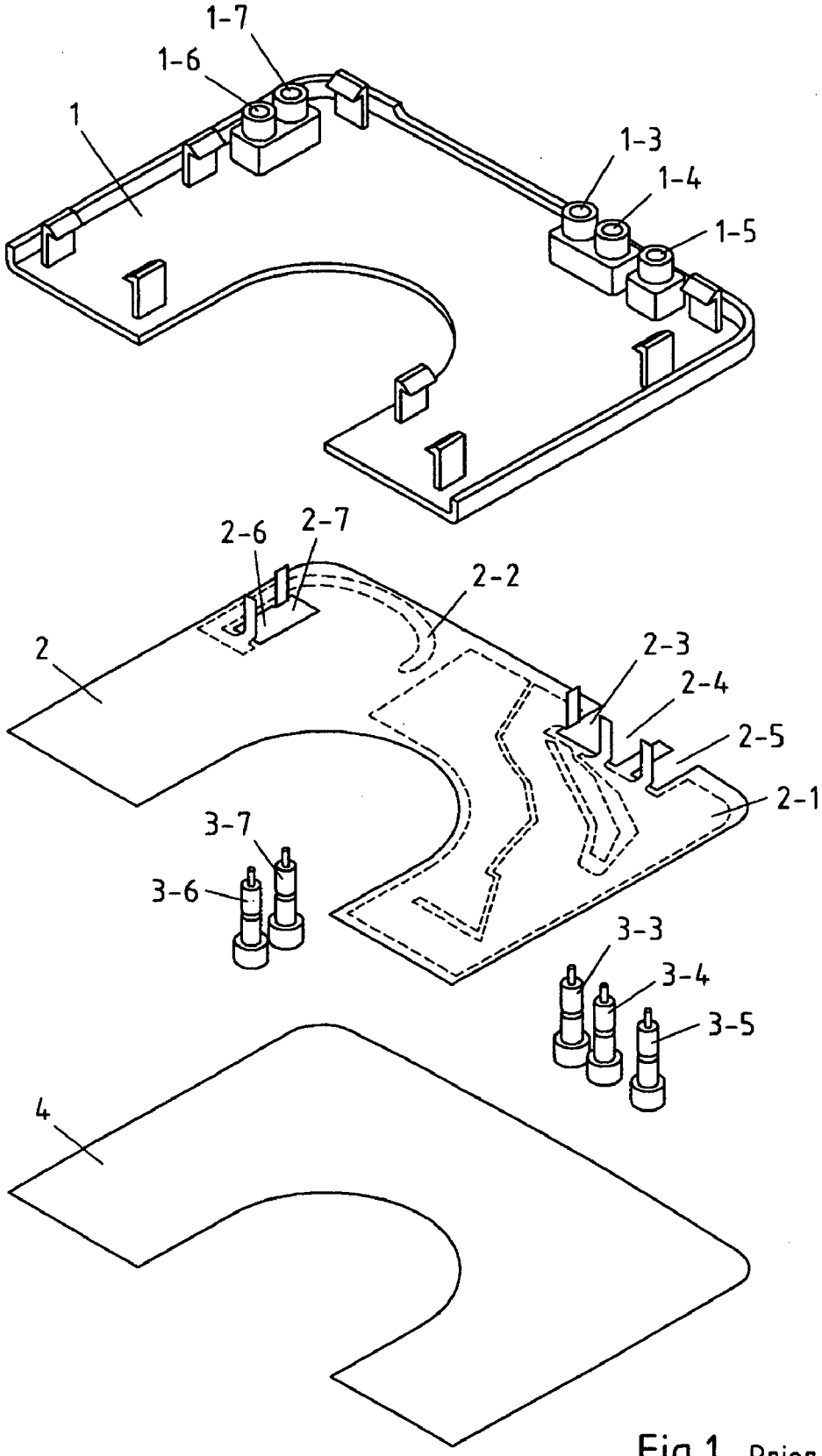
Fig.1 Prior Art
FIG. 1: An exploded view of an antenna structure according to the prior art.

In contrast to the assembly of FIG. 1, in FIGS. 2–4, an additional backside flex-print 5 according to the present invention is attached to the second side of the antenna carrier 1 in order to improve the gain of the radiation structure 2-2. The material used for the backside flex-print is the same material as used for the flex-print 2, i.e. it consists of a 100 μm PET film that is covered by a 20 μm copper layer and has a 100 μm layer of adhesive under the PET layer. The adhesive layer is used to attach the backside flex-print 5 to the antenna carrier 1, so that the copper layer of the backside flex-print 5 is visible in the view of FIGS. 2 and 4.

As can be seen from FIGS. 2–4, this backside flex-print 5 partially overlaps the radiation structure 2-2, is essentially plane (similar to a filled quarter circle) and not connected to the ground pins (3-4 and 3-5) or other metallic elements of the device the antenna structure is housed in. The backside flex-print 5 thus acts as a parasitic antenna element, the copper layer of which couples with the radiation structure 2-2 through the PET layer of the backside flex-print 5, the antenna carrier 1 and the PET layer of the flex-print 2. Said coupling allows to influence the radiation pattern of the radiation structure 2-2, for instance the gain at a given frequency and/or angle.

As in FIG. 1, the radiation structures 2-1 (GSM) and 2-2 (GPS) are obtained on said flex-print 2 by punching out or etching, and are protected with a decorative label 4 of 200 μm thickness. Connection between the radiation structures 2-1 and 2-2 and the central circuit board of the mobile phone (not shown) is accomplished by pogo pins 3-3 . . . 3-7. The pogo pins 3-3 . . . 3-7 connect to the noses 2-3 . . . 2-7 of the radiation structures 2-1 and 2-2 via a press fit, obtained by snapping the respective pogo pin 3-3 . . . 3-7 into the respective opening 1-3 . . . 1-7 of the antenna carrier and in the process dragging said respective nose 2-3 . . . 2-7 into said respective opening 1-3 . . . 1-7. The snap function of the opening 1-3 . . . 1-7 ensures that there exists no pull or drag force in the connection between the pogo pin 3-3 . . . 3-7 and the respective nose 2-3 . . . 2-7. In the present antenna structure, pogo pin 3-6 contacts the radiation structure 2-2 of the GPS antenna, pogo pin 3-3 contacts the radiation structure 2-1 of the GSM antenna, and pogo pins 3-3 and 3-4 contact the ground plane of the GSM (PIFA) antenna that is also formed on the flex-print 2, as can be seen clearly seen in the left part of FIG. 3. Apparently, pogo pin 3-7 is not used in FIGS. 3 and 4, because sufficient contacting of the radiation structure 2-2 may be achieved by pogo pin 3-6 alone.

The material of the antenna carrier 1 in FIGS. 2–4 is Questra (sold by Dow Chemical Company), with a relative permeability of $\epsilon_r$=2.5 and a dielectric loss factor of tan δ=0.0001. The thickness of the flat portions of antenna carrier 1 was 800 μm.

By adding the backside flex-print 5 to a state-of-the-art antenna structure as proposed by the present invention, an average gain improvement of at least 2 dB in the E plane can be achieved for the desired radiation area. This advantageously allows for a reduction of the required transmission power and/or an increase of the coverage area of the system the device with the improved antenna is operated in.

Figure 5:
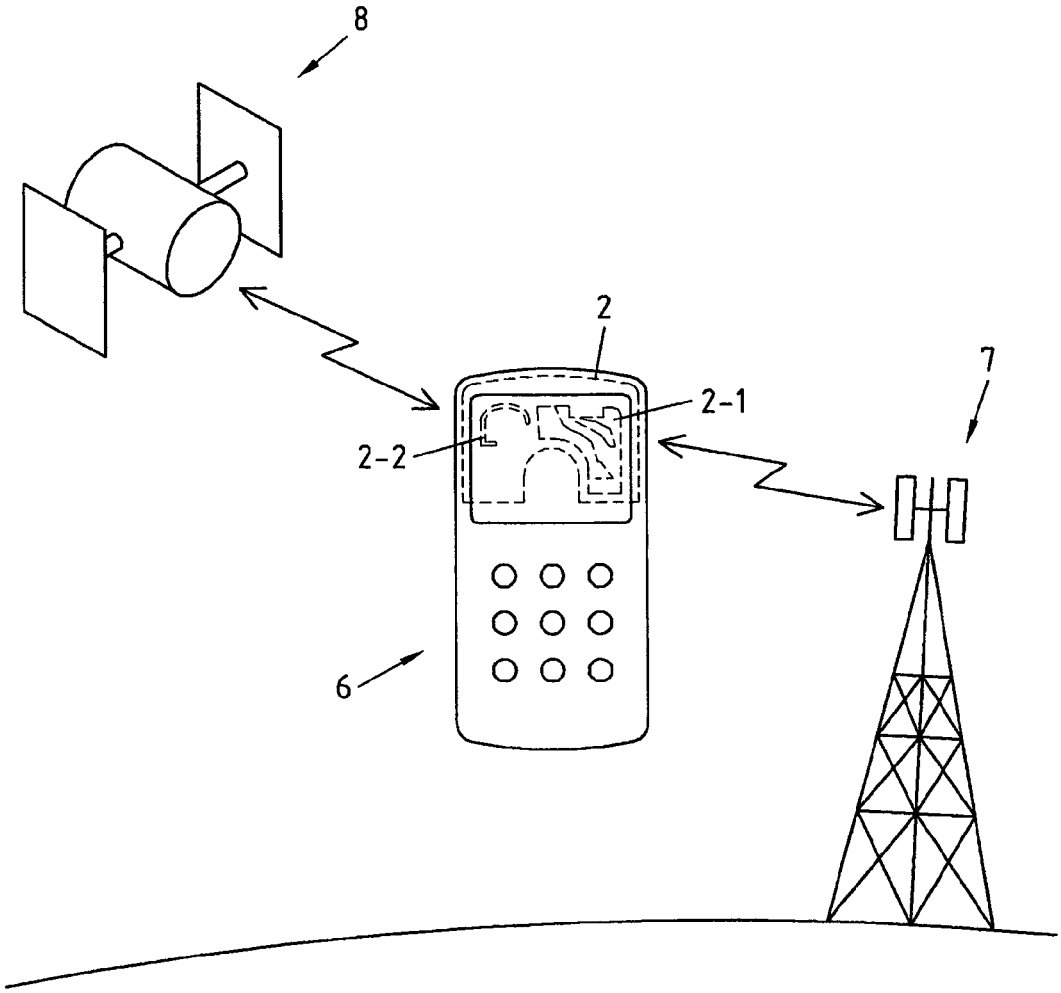
FIG. 5: a schematic view of a system according to the present invention.

FIG. 5 is a schematic view of a system according to the present invention. The system comprises a mobile phone 6, a base station 7 of a mobile radio system and a satellite 8 of a satellite navigation system. The mobile phone 6 contains an antenna carrier 1 with a flex-print 2 on a first side, wherein radiation structures 2-1 and 2-2 are formed on said flex-print 2, and with a back flex-print 5 formed on its second side. For simplicity of presentation, only the flex-print 2 and the radiation structures 2-1 and 2-2 are depicted in the mobile phone 6 of FIG. 5. Said radiation structure 2-1 is tuned for a frequency range that allows the mobile phone 6 to communicate with an antenna of said base station 7, which may for instance operate according to the GSM or UMTS mobile radio communication standard. Said radiation structure 2-2 is tuned to a frequency range that allows the mobile phone 6 to communicate with a satellite 8 of a satellite navigation system, as for instance the GPS or Galileo navigation system, and thus to determine its position.

The invention has been described above by means of preferred embodiments. It should be noted that there are alternative ways and variations which are obvious to a skilled person in the art and can be implemented without deviating from the scope and spirit of the appended claims. In particular, the shape of the back-side flex-print and the shape of the radiation structure(s) on the flex-print may substantially differ from the shapes as shown in the embodiments, and different PWBs or materials for the antenna carrier may be used. The thickness of the layers in the PWB and of the antenna carrier and decorative labels may also differ, and in particular it might be advantageous to use PWB with more than one metallic and/or dielectric layer. Also different techniques of forming the radiation structures and ground planes may be applied, and contact elements different from the presented pogo pins may be used. Finally, the present invention is not restricted to internal antennas that are used in hand-held devices; equally well, external antennas may be constructed in this way.

What is claimed is:

1. A device, comprising:

an at least partially plane antenna carrier with a first side and a second side, at least one first printed wiring board being attached to said first side of said antenna carrier and having at least one radiation structure formed on said at least one first printed wiring board, and at least one second printed wiring board being attached to said second side of said antenna carrier, wherein the antenna carrier is located between the at least one first printed wiring board and the at least one second printed wiring board, wherein said at least one second printed wiring board acts as a parasitic antenna element, and wherein said at least one first printed wiring board is positioned on said first side of said antenna carrier and said at least one second printed wiring board is positioned on said second side of said antenna carrier so that at least one of said at least one second printed wiring board partially overlaps at least one of said at least one radiation structure formed on said at least one first printed wiring board.

2. The device according to claim 1, wherein said first or second printed wiring boards are one layer printed wiring boards that comprise at least one metallic layer or at least one dielectric layer.

3. The device according to claim 1, wherein said first or second printed wiring boards further comprise at least one adhesive layer, and wherein said first or second printed wiring boards are attached to said antenna carrier via said adhesive layer.

4. The device according to claim 1, further comprising a protection layer that at least partially covers said first PWB.

5. The device according to claim 1, further comprising at least one pogo pin that penetrates said antenna carrier to electrically contact said radiation structure of said first PWB.

6. The device according to claim 1, wherein said first radiation structure is essentially line-shaped.

7. The device according to claim 6, wherein said first radiation structure is at least partially bent.

8. The device according to claim 1, wherein said at least one second printed wiring board is essentially planar.

9. The device according to claim 1, wherein said antenna carrier consists of a dielectric material.

10. The device according to claim 1, wherein said device is a hand-held device, in particular a global-positioning-system-capable or Galileo-capable mobile phone.

11. A device, comprising:

an at least partially plane antenna carrier with a first side and a second side, at least one first printed wiring board being attached to said first side of said antenna carrier and having at least one radiation structure formed on it, and at least one second printed wiring board attached to said second side of said antenna carrier, wherein the antenna cairier is located between the at least one first printed wiring board and the at least one second printed wiring board, wherein a second radiation structure is formed on said at least one first printed wiring board, wherein said first radiation structure is tuned to a first frequency range and wherein said second radiation structure is tuned to at least one second frequency range, and wherein said first printed wiring board is positioned on said first side of said antenna carrier and said second printed wiring board is positioned on said second side of said antenna carrier so that at least one of said at least one second printed wiring board partially overlaps at least one of said at least one radiation structure formed on said at least one first printed wiring board.

12. The device according to claim 11, wherein said first frequency range is a frequency range of a satellite navigation system and wherein said at least one second frequency range is a frequency range of a mobile radio system.

13. The device according to claim 11, wherein said first or second printed wiring boards are one layer printed wiring boards that compriste at least one metallic layer or at least one dielectric layer.

14. The device according to claim 13, wherein said first or second printed wiring boards are one layer printed wiring boards that compriste at least one metallic layer or at least one dielectric layer.

15. A device comprising:

an at least partially plane antenna carrier with a first side and a second side, at least one first printed wiring board being attached to said first side of said antenna carrier and having a first and a second radiation structure formed on it, and at least one second printed wiring boad being attached to said second side of said antenna carrier as a parasitic antenna element, wherein the antenna carrier is located between the at least one first printed wiring board and the at least one second printed wiring board, wherein said first radiation structure is tuned to a first frequency range and wherein said second radiation structure is tuned to at least one second frequency range, and wherein said at least one first printed wiring board is positioned on said first side of said antenna carrier and said at least one second printed wiring board is positioned on said second side of said antenna carrier so that said at least one of said at least one second printed wiring board partially overlaps at least one of said first and second radiation structures.

16. The device according to claim 15, wherein said first or second printed wiring boards are one layer printed wiring boards that compriste at least one metallic layer or at least one dielectric layer.

17. A method comprising:

generating a radiation pattern of an antenna, wherein said antenna comprises an at least partially plane antenna carrier with a first side and a second side, and at least one first printed wiring board that is attached to said first side of said antenna carrier and has at least one radiation structure formed on it, said method including attaching at least one second printed wiring board to said second side of said antenna carrier, wherein said at least one second printed wiring board acts as a parasitic antenna element, and said method also including positioning said at least one first printed wiring board on said first side of said antenna carrier and said at least one second printed wiring board on said second side of said antenna carrier so that at least one of said at least one second printed wiring board partially overlaps at least one of said at least one radiation structure.

18. The method according to claim 17, wherein said first or second printed wiring boards are one layer printed wiring boards that compriste at least one metallic layer or at least one dielectric layer.

19. A computer program with instructions stored on a processor-readable medium, said instructions operable to cause a processor to control a radiation of an antenna, wherein said antenna comprises an at least partially plane antenna carrier with a first side and a second side, at least one first printed wiring board being attached to said first side of said antenna carrier and having at least one radiation structure formed on it, and at least one second printed wiring board being attached to said second side of said antenna carrier, wherein said at least one second printed wiring board acts as a parasitic antenna element, wherein the antenna carrier is located between the at least one first printed wiring board and the at least one second printed wiring board, and wherein said at least one first printed wiring board is positioned on said first side of said antenna carrier and said at least one second printed wiring board is positioned on said second side of said antenna carrier so that at least one of said at least on second printed wiring board partially overlaps at least one of said at least one radiation structure.

20. The computer program according to claim 19, wherein said first or second printed wiring boards are one layer printed wiring boards that compriste at least one metallic layer or at least one dielectric layer.

21. A radio system, comprising:

at least one base station, and at least one mobile station, wherein said at least one mobile station comprises an at least partially plane antenna carrier with a first side and a second side, at least one first printed wiring board being attached to said first side of said antenna carrier and having at least one radiation structure formed on it, and at least one second printed wiring board being attached to said second side of said antenna carrier, wherein said at least one second printed wiring board acts as a parasitic antenna element, wherein the antenna carrier is located between the at least one first printed wiring board and the at least one second printed wiring board, and wherein said at least one first printed wiring board is positioned on said first side of said antenna carrier and said at least one second printed wiring board is positioned on said second side of said antenna carrier so that at least one of said at least one second printed wiring board partially overlaps at least one of said at least one radiation structure.

22. The radio system according to claim 21, wherein said mobile station is capable of receiving signals transmitted by at least one satellite and of at least partially determining its position from said received signals.

23. The system according to claim 21, wherein said first or second printed wiring boards are one layer printed wiring boards that compriste at least one metallic layer or at least one dielectric layer.

24. A device, comprising:

an at least partially plane means for carrying antennas, said means for carrying antennas having a first side and a second side, at least one first wiring means being attached to said first side of said means for carrying antennas, and having at least one radiation means formed on said first wiring means, and at least one second wiring means being attached to said second side of said means for carrying antennas, wherein the means for carrying antennas is located between the at least one first wiring means and the at least one second wiring means, wherein said at least one second wiring means acts as a parasitic antenna element, and wherein said at least one first wiring means is positioned on said first side of said means for carrying antennas and said at least one second wiring means is positioned on said second side of said means for carrying antennas so that at least one of said at least one second wiring means partially overlaps at least one of said at least one radiation means.

* * * * *

UNITED STATES PATENT AND TRADEMARK OFFICE

CERTIFICATE OF CORRECTION

PATENT NO. : 7,193,569 B2
APPLICATION NO. : 10/755715
DATED : March 20, 2007
INVENTOR(S) : J. Vesterinen It is certified that error appears in the above-identified patent and that said Letters Patent is hereby corrected as shown below:

col. 9, line 35, please change “compriste” to --comprise--;

at line 39, please change “compriste” to --comprise--;

at line 66, please change “compriste” to --comprise--.

col. 10, line 23, please change “compriste” to --comprise--;

at line 45, please change “compriste” to --comprise--.

col. 11, line 7, please change “compriste” to --comprise--.

Signed and Sealed this

Third Day of June, 2008

JON W. DUDAS
*Director of the United States Patent and Trademark Office*